US009889325B2

(12) United States Patent
Speck et al.

(10) Patent No.: US 9,889,325 B2
(45) Date of Patent: Feb. 13, 2018

(54) SET OF LADDERS, IN PARTICULAR FIRE LADDER AND VEHICLE EQUIPPED THEREWITH

(71) Applicant: Rosenbauer International AG, Leonding (AT)

(72) Inventors: Christoph Speck, Durmersheim (DE); Stefan Ziegelmeyer, Mannheim (DE); Thomas Mueller, Dernbach (DE)

(73) Assignee: Rosenbauer International AG, Leonding (AT)

( * ) Notice: Subject to any disclaimer, the term of this patent is extended or adjusted under 35 U.S.C. 154(b) by 94 days.

(21) Appl. No.: 14/654,072

(22) PCT Filed: Dec. 20, 2013

(86) PCT No.: PCT/AT2013/050259
§ 371 (c)(1),
(2) Date: Jul. 17, 2015

(87) PCT Pub. No.: WO2014/094026
PCT Pub. Date: Jun. 26, 2014

(65) Prior Publication Data

US 2015/0345220 A1 Dec. 3, 2015

(30) Foreign Application Priority Data

Dec. 21, 2012 (AT) ..... A 50617/2012

(51) Int. Cl.
*A62C 27/00* (2006.01)
*E06C 5/04* (2006.01)

(52) U.S. Cl.
CPC ..... *A62C 27/00* (2013.01); *E06C 5/04* (2013.01)

(58) Field of Classification Search
CPC ..... A62C 27/00; E06C 5/04
See application file for complete search history.

(56) References Cited

U.S. PATENT DOCUMENTS 37,470 A * 1/1863 Willis ..... E06C 5/04 182/208
231,567 A * 8/1880 Harris ..... E06C 5/04 182/102

(Continued)

FOREIGN PATENT DOCUMENTS

AT 513612 A4 * 6/2014 ..... E06C 5/04
AT 513612 A4 * 6/2014 ..... E06C 5/04

(Continued)

OTHER PUBLICATIONS

International Search Report of PCT/AT2013/050259, dated May 6, 2014.

*Primary Examiner* — Colleen M Chavchavadze
*Assistant Examiner* — Candace L Bradford
(74) *Attorney, Agent, or Firm* — Collard & Roe, P.C.

(57) ABSTRACT

The invention relates to a set of extendable ladders, in particular firefighting ladders, consisting of at least two ladder parts, each part being formed from side rails and rungs running between the side rails, and the uppermost ladder part is formed from at least two ladder sections interconnected by an articulated link, the articulation axis of which runs substantially parallel with the rungs, and when the uppermost ladder part has been fully retracted into the ladder part lying below, the first ladder section and the second ladder section overlap the ladder part lying below. In order to increase flexibility and the range of use of the set of ladders, at least the ladder part lying directly below the uppermost ladder part has a gap which, in the head region of the ladder part between the side rails, is open towards the tip of the ladder and is continuous between the front face and rear face of the ladder part, such that when the articulation axis overlaps the ladder part lying directly below the upper- (Continued)

Figure 1:
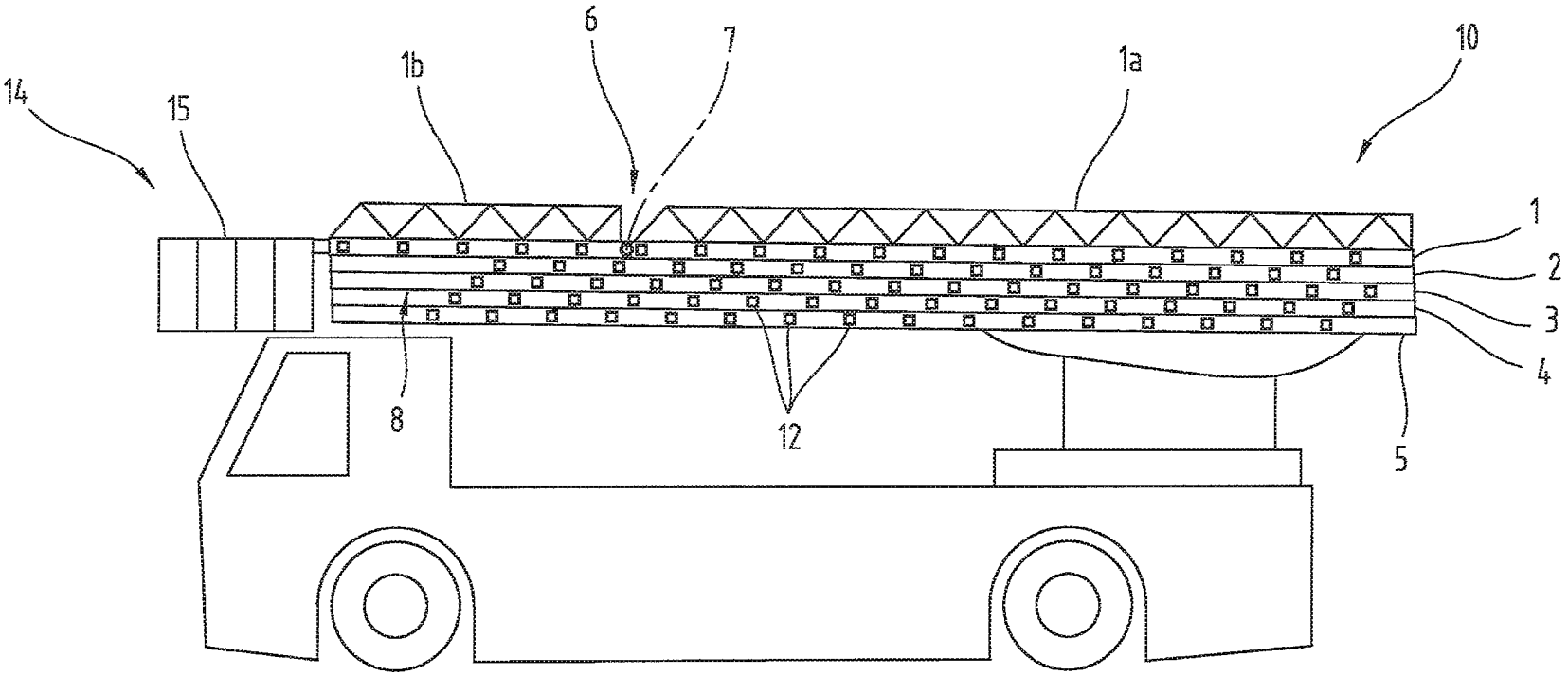

most ladder part, the second ladder section can be tilted through the gap about the articulation axis.

20 Claims, 11 Drawing Sheets

(56) References Cited

U.S. PATENT DOCUMENTS

| | | | | | |
|---|---|---|---|---|---|
| 1,711,358 | A * | 4/1929 | Lundahl | E06C 5/04 | 182/67.2 |
| 1,761,726 | A * | 6/1930 | Havens | B66F 11/044 | 182/1 |
| 3,262,517 | A * | 7/1966 | Malec | B66F 11/046 | 182/127 |
| 3,966,017 | A * | 6/1976 | Maeda | E06C 5/04 | 182/18 |
| 4,366,591 | A * | 1/1983 | Zimmerman | B63B 27/14 | 14/71.3 |
| 6,640,928 | B1 * | 11/2003 | Ridley, Jr. | E04G 1/30 | 182/208 |
| 7,448,470 | B2 * | 11/2008 | Brown | B66F 11/042 | 182/63.1 |
| 2002/0079163 | A1 * | 6/2002 | Figura | E06C 5/04 | 182/2.5 |
| 2005/0247524 | A1 * | 11/2005 | Wissler | E06C 5/04 | 182/207 |
| 2006/0070845 | A1 * | 4/2006 | Crookston | B65G 21/14 | 198/312 |
| 2006/0086566 | A1 * | 4/2006 | Linsmeier | B66C 13/12 | 182/2.3 |
| 2007/0240936 | A1 * | 10/2007 | Brookshire, Jr. | E06C 5/04 | 182/127 |
| 2011/0203872 | A1 | 8/2011 | Hoersch et al. | | |

FOREIGN PATENT DOCUMENTS

| | | | | |
|---|---|---|---|---|
| AT | 513614 | A4 * | 6/2014 | A62C 27/00 |
| AT | 513614 | A4 * | 6/2014 | A62C 27/00 |
| CN | 1237464 | A | 12/1999 | |
| CN | 201254946 | Y | 6/2009 | |
| DE | 2946521 | A1 * | 5/1981 | E06C 5/04 |
| DE | 2946521 | A1 * | 5/1981 | E06C 5/04 |
| DE | 9 416 367 | U1 | 12/1994 | |
| DE | 19945240 | A1 * | 6/2001 | E06C 1/397 |
| DE | 19945240 | A1 * | 6/2001 | E06C 1/397 |
| DE | 10 2005 024585 | A1 | 11/2006 | |
| EP | 0317891 | A2 * | 5/1989 | A62C 27/00 |
| EP | 0317891 | A2 * | 5/1989 | A62C 27/00 |
| EP | 2 182 164 | A1 | 5/2010 | |
| EP | 2182164 | A1 * | 5/2010 | E06C 5/04 |
| EP | 2182164 | A1 * | 5/2010 | E06C 5/04 |
| JP | 2003 310779 | A | 11/2003 | |
| WO | WO 2006015242 | A2 * | 2/2006 | B66C 23/64 |
| WO | WO-2006015242 | A2 * | 2/2006 | B66C 23/64 |
| WO | WO-2010097512 | A1 * | 9/2010 | B66C 23/36 |
| WO | WO 2010097512 | A1 * | 9/2010 | B66C 23/36 |

* cited by examiner

SET OF LADDERS, IN PARTICULAR FIRE LADDER AND VEHICLE EQUIPPED THEREWITH

CROSS REFERENCE TO RELATED APPLICATIONS

This application is the National Stage of PCT/AT2013/050259 filed on Dec. 20, 2013, which claims priority under 35 U.S.C. § 119 of Austrian Application No. A 50617/2012 filed on Dec. 21, 2012, the disclosure of which is incorporated by reference. The international application under PCT article 21(2) was not published in English.

The invention relates to a set of extendable ladders, in particular firefighting ladders, comprising at least two ladder parts, each of which is formed from side rails and rungs extending between the side rails, and the uppermost ladder part is formed from at least two ladder sections interconnected by an articulated link, the articulation axis of which extends substantially parallel with the rungs, and when the uppermost ladder part has been fully retracted into the ladder part lying below, the first ladder section and the second ladder section overlap the ladder part lying below. The invention further relates to a vehicle, in particular a firefighting and aerial rescue vehicle, having a ladder set in the form of a turntable ladder.

In this section, the known solutions for turntable ladders with an articulating part will be described.

DE9416367U1 discloses a turntable ladder for rescue vehicles having a multi-part ladder set comprising a number of telescopically extendable ladder parts, each having a bottom spar with rungs and a top spar serving as handrails. The uppermost ladder part is split into two parts and comprises an inner part of a length approximately the same as that of the ladder part lying directly underneath and an outer part which is mounted in an articulated arrangement on the inner part by means of an articulated link having a horizontal articulation axis. The inner part is extended by means of the additional outer part. The articulation axis lies outside the ladder part disposed directly underneath the uppermost ladder part, i.e. the articulation axis does not overlap the ladder part lying directly below. In the base position, the outer part extends forwards above the driver's cab and serves as an extension of the ladder set, which can be pivoted about the articulation axis. A working cage is secured to the end of the outer part remote from the articulation axis, i.e. to the ladder tip. The working cage can be pivoted and set down on the ground to enable direct access and egress by rescue teams.

Due to the articulated link, such ladders are also referred to as articulated ladders and the outer part is also referred to as an articulated arm. For example, there are ladders on the market with a 5-part ladder set and a short articulated arm on the uppermost ladder part, and the articulation point is disposed outside of the ladder set. The articulated part projecting out from the telescoping section of the ladder set results in an impractical overall length. For a given vehicle length, the length of the articulated part has a very negative effect on the geometry of the ladder set (ladder packet length). In order to obtain a required total length with the ladder set fully extended, either the vehicle has to be made longer in order to be able to accommodate a ladder set of sufficient length or the number of ladder parts has to be increased. However, neither of these measures is desirable, firstly because of the extra space requirement of the vehicle and secondly because of the extra weight. In order to satisfy stability requirements, the ladder set has to be made heavier in order to obtain a greater radius or allowance must be made for a loss of radius.

DE102005024585A1 discloses a turntable ladder for rescue vehicles having a number of telescopically extendable ladder parts, on the uppermost one of which an articulating arm is mounted so as to be pivotable about a horizontal articulation axis. When the turntable ladder is fully retracted, the articulation axis is disposed outside the ladder part lying below. The articulating arm itself comprises two parts, one part being telescopically extendable out of the other part. Although this means that the space requirement for the articulating arm extending out of the ladder set is reduced, there is nevertheless a considerable amount of weight at the ladder tip, which has a detrimental effect on the stability and maximum radius of the turntable ladder.

EP2182164A1 discloses a ladder set comprising several extendable ladder parts. The uppermost ladder part comprises a first ladder section and a second ladder section (articulating part) which are connected to one another by an articulated link. The length of the uppermost ladder part is substantially the same as the lengths of the ladder parts lying below. When the ladder set is in the retracted state, the articulated link is disposed inside the ladder set, i.e. it overlaps the ladder parts lying below. This means that the uppermost ladder part has to first of all be extended to the degree that the link or articulation axis is outside of the ladder part lying below. Only then can the second ladder section (articulating part) be tilted. In the case of a long articulating part, it will need a large minimum radius or ladder length. The articulating part is guided by shoes on the ladder part lying below until the uppermost ladder part has reached the head rollers after the articulation point. Only then is the uppermost ladder part guided on the head rollers. The articulating arm lies on the head roller and is guided by it as a result. It is not until the cylinder lying underneath travels across the roller that it slides on a shoe block in order to bridge the distance to the piston rod. In order to prevent collisions when retracting the ladder parts, care must be taken to ensure that the articulating part is extended before the uppermost ladder part can be fully retracted.

A similar known ladder set comprises four ladder parts, of which the uppermost ladder part can be moved by means of a separate winch (single extension), whilst the other three ladder parts are moved synchronously by means of a second winch. As was the case with EP2182164A1, the articulation point can be retracted into the ladder set.

From the prior art, solutions are known whereby the articulation point is disposed in the bottom spar, and there are also solutions whereby the articulation point is disposed in the top spar. The link cylinders used as the operating system for pivoting the articulating part down and up are then disposed in the other spar in each case.

The disadvantage of the known solutions whereby the articulation point is retracted across the ladder part lying below is that the ladder set must firstly be extended to a very significant degree to enable the articulating part to be inclined at all. During retraction, there is a risk of collisions if the articulating part is not yet extended.

Another disadvantage of a retractable articulating part is that that the uppermost ladder part, which is usually guided on head rollers of the ladder part lying below, moves with the articulation point across the head roller, resulting in a height offset or undesired discontinuity of movement. Travel across the head roller causes undesired shaking of the rescue team and rescued person being carried by the platform. The discontinuity is therefore clearly perceptible on the platform, which is not a pleasant experience. Furthermore, it can lead to premature wear of the parts involved. Another disadvantage of the prior art is that climbing from the first ladder section onto the second ladder section (articulating part) poses risks if the latter is inclined because it is more difficult to get a reliable grip. The objective of the invention is to propose a ladder set that does not have these disadvantages and which is distinctive due to a large outreach, in particular also on balconies and in underfloor areas (wharves and bridges) and by means of which the working platform can be set down on the ground, in particular in front of the driver's cab. The ladder set should be such that the overall vehicle length can be kept short and the kinematic sequences and continuity are uncomplicated. It should be possible to obtain a large spread between minimum and maximum radius. The ladder set should also be characterized by a low space requirement when moving the ladders, a low space requirement when setting the working platform down on the ground, a short set-up time and simple control engineering.

This objective is achieved by means of a ladder set of the type outlined above, due to the fact that at least the ladder part lying directly below the uppermost ladder part has a gap which, in the head region of the ladder part between the side rails, is open towards the tip of the ladder and is continuous between the front face and rear face of the ladder part, such that when the articulation axis is in a position overlapping the ladder part lying directly below the uppermost ladder part, the second ladder section can be tilted through the gap about the articulation axis.

The invention enables the second ladder section, also referred to as the articulating part, to be tilted, including in a position in which the articulation axis of the articulated link has not been fully extended beyond the ladder part lying below. This increases the flexibility and range of use of a ladder set. A major advantage of the invention resides in the fact that the length of the uppermost ladder part and hence the total length of the ladder set does not have to be made longer to enable tilting, including in a (partially and/or fully) retracted state.

The gap in the head region of the ladder part(s) lying below is free of continuous rungs and at least wide enough for the second ladder section (namely, the articulating arm) to fit through the gap by its width. The gap is disposed between the side rails or sides of the ladder part and extends between the uppermost continuous rung and the ladder part tip, and the gap is open towards the tip of the ladder so that the second ladder section can be tilted through the gap (about the articulation axis). The head region of a ladder part forming a gap is therefore "fork-shaped".

When the ladder set is in a fully retracted position, at least one region of the second ladder section overlaps the gap lying underneath. Depending on the length of the gap, (extension in the direction along the side rails) and the position of the articulation axis during the tilting operation, a part of the second ladder part section overlaps or intersects the side rails of the ladder part(s) lying below.

The articulating part can therefore be moved both when the ladder set is at least partially retracted and when it is fully retracted. Based on a preferred variant, the gap (including that in the ladder part lying below) is dimensioned so that even when all the ladder parts are in the fully retracted position, the articulating part can still be tilted. In this case, there are no restrictions imposed by the hydraulic system or control engineering making it necessary to ensure that the articulating part is extended before it can be completely retracted. Based on this variant, the uppermost ladder part can be fully retracted even with the second ladder section tilted and can then be extended again, i.e. moved into a position aligned with the first ladder section.

The ladder set and the second ladder section cannot be damaged if they are retracted without having completely aligned the second ladder section beforehand, even during emergency operation.

It would even be conceivable to build a ladder so that its articulating link can be tilted whilst the ladder set is in the ladder support.

The principle underlying one embodiment will be briefly explained below. In the retracted state, the articulation axis of the articulated link is disposed inside the ladder set. By providing a gap, amongst other things by omitting rungs in the ladder parts with effect from the second ladder part (i.e. the ladder part lying directly below the uppermost ladder part), it is possible to incline the second ladder section (articulating part) to a certain extent regardless of the ladder extending movement.

The rungs may be respectively omitted in that region of a ladder part which overlaps the ladder part lying respectively underneath when the ladder set is fully extended, i.e. within the smallest overlap of the ladder parts. This makes it possible to climb the ladder set continuously.

In some variants of the invention, the configuration may be such that the entire range of movement of the articulating part can be used with the ladder set fully retracted. Alternatively, other designs are conceivable where the entire range of movement of the articulating part cannot be used when the ladder set is fully retracted, in which case rungs are still provided in the bigger, bottom ladder parts. Based on another variant, the configuration may be such that the uppermost ladder part has to be extended with the ladder part lying directly below by a certain amount before the articulating part can be tilted. In this instance, however, the articulation point is still disposed within at least one ladder part. These designs are useful if dispensing with too many rungs would lead to a mechanical overload of the ladder parts.

The invention is suitable for sequential, synchronous or combined extension systems and offers the advantages described above with all systems equally.

What is proposed, therefore, is a ladder set with an articulating part (second ladder section) in the uppermost ladder part, the articulation axis of which can be retracted inside the other ladder parts. In the region where the ladder parts overlap, a gap of at least the width of the articulating part is provided so that in ladder positions in which the articulation axis is disposed inside at least one of the other ladder parts, the articulating part can be tilted through at least one ladder part. In the region where the ladder parts overlap, the gap is of at least the same width as the articulating part so that the ladder set can be partially or even completely retracted at all articulation angles.

The extension of the gap in the direction along the side rails is preferably greater than the distance between two adjacent rungs of a ladder part. In this respect, distance means the regular rung spacing used for the majority of rungs of the ladder set. The longer the gap is, the lesser the degree to which the uppermost ladder part has to be extended from the ladder part lying below to enable the second ladder section to be tilted.

The extension of the gap in the direction along the side rails is preferably at least twice as big, preferably three times as big, as the distance between two adjacent rungs of a ladder part. This further shortens the degree to which the uppermost ladder part has to be extended before the articulating part can be tilted.

The extension of the gap in the direction along the side rails is preferably at least a quarter, preferably at least half, of the length of the second ladder section, which will shorten the requisite extension distance relative to the length of the second ladder section even further.

The extension of the gap in the direction along the side rails preferably substantially corresponds to the length of the second ladder section, thereby enabling the second ladder section to be tilted even if the uppermost ladder part is fully retracted.

At least two of the ladder parts lying underneath the uppermost ladder part preferably have a gap respectively so that when the second ladder section is in a position in which the articulation axis overlaps the at least two ladder parts, it can be tilted through the gaps about the articulation axis. In this embodiment, the articulating part can also be tilted through two ladder parts.

The extension of the gap in the direction along the side rails in one of the ladder parts is preferably bigger than in the other ladder part. This enables the second ladder section to be tilted, with the ladder part lying below retracted, by a specific angle which, in many cases, is already enough to set a platform attached to the end of the articulating part down on the ground. With a corresponding shortening of the gap in the direction of the bottom ladder part, this feature provides optimum stability for the ladder set.

It is preferable if all of the ladder parts lying below the uppermost ladder part each have a gap so that when the second ladder section is in a position in which the ladder parts lying below are fully retracted and the articulation axis overlaps the ladder part lying below, it can be tilted through the gaps about the articulation axis. In this instance, the second ladder section of the uppermost ladder part can be tilted through all of the ladder parts lying below.

The side rails of the first ladder section preferably extend beyond the articulation axis and at least partially overlap the second ladder section.

This makes it easier to climb between the first ladder section and the second ladder section, even in the inclined position, because the sections of the side rails (side walls) extending beyond the articulation axis can be used to hold onto. The sections of the side rails extending beyond the articulation axis preferably comprise at least a bottom spar or its extension out from the first ladder section.

This variant additionally enables the first ladder section to be guided without any height offset and thus without causing vibrations during travel across an offset or a sliding element, preferably across the full extending movement of the first ladder section. This embodiment also enables a continuous guiding action from the side, from above and from below by the next bigger ladder part.

One advantage achieved as a result is that the entire uppermost ladder part can continue to be guided on the ladder part lying below by means of a pair of head rollers. A anti-derail lock and lateral guides for the uppermost ladder part can also be positioned or mounted in the head region of the ladder part lying below the uppermost ladder part, as a result of which the transmitted forces and hence mechanical stability remain constant with a minimum overlap (extended position) of the ladder parts compared with a solution without an articulating link.

In this instance, the second ladder section is slimmer than the first ladder section so that it can be retracted in the extended state.

Instead of or in addition to rollers, it would naturally also be conceivable to provide sliding blocks as guide elements.

The sections of the side rails extending beyond the articulation axis (or side walls) are preferably at least twice as long as the distance between two adjacent rungs of a ladder part. In other words, in this embodiment, the side rail runs continuously. This enables a reliable grip to be provided at the transition.

The length of the sections of the side rails extending beyond the articulation axis (or side walls) is preferably at least a quarter, preferably at least half, of the length of the second ladder section. This being the case, the longer side rails already fulfil a considerable supporting function on the ladder part lying below.

Based on another variant, the sections of the side rails extending beyond the articulation axis of the first ladder section may be of substantially the same length as the second ladder section (articulating part). In the retracted state, the side rails (or side walls) of the uppermost ladder parts extend to the end of the ladder part lying below.

The side walls of the first ladder section may therefore be extended to the length of the second ladder section (or articulating arm) so that the head rollers of the ladder part lying below can provide a guiding action across the entire extending movement of the uppermost ladder part and can do so without a height offset. In the case of a synchronous extending system, this does not impose any restrictions on the ladder extending movement of any of the ladder parts.

The uppermost ladder part is preferably guided along or on guide elements mounted in the ladder part lying below, and when the uppermost ladder part is in the position fully retracted into the ladder parts lying below, the sections of the side rails of the first ladder section extending beyond the articulation axis lie against or on the guide elements. These guiding or sliding elements, which would otherwise cause a height offset during travel across them or on leaving the second ladder section, support the first ladder section in the retracted state already due to the invention so that there is preferably no transition at all. This improves the kinematics of the ladder set and preserves the stability of the ladder set.

It is preferable if guide elements lie against the sections of the side rails of the first ladder section extending beyond the articulation axis from underneath and/or from the side and/or from above, thereby ensuring a higher degree of safety.

The guide elements are preferably disposed in the head region of the ladder part lying below, thereby ensuring that the first ladder section can be reliably supported and guided right into the head region.

The guide elements are preferably rotatably mounted rollers, thereby reducing friction, deployment of force and noise.

The side rails of the uppermost ladder part preferably comprise a bottom spar and a top spar, and the articulation axis of the articulated link is provided in the bottom spar or top spar of the uppermost ladder part. The design based on a bottom and top spar results in a stable ladder part.

Naturally, it would also be possible for the articulation axis to be provided in the region between the top spar and bottom spar.

The uppermost ladder part is preferably of substantially the same length as the ladder part lying directly below the uppermost ladder part, thereby avoiding excessively protruding ladder parts whilst requiring a small amount of space for the ladder set in spite of higher functionality.

The second ladder section preferably supports a platform at its end remote from the articulation axis (i.e. at the ladder tip) in particular in the form of a working cage for accommodating one or more rescue crew members, in particular firefighters, as well as persons to be rescued and/or loads (e.g. equipment, tools, etc.).

The ladder set is preferably provided in the form of a turntable ladder, thereby further increasing flexibility.

The ladder set is preferably disposed on an emergency vehicle, in particular a firefighting truck, and is a constituent part of a turntable ladder.

The objective outlined earlier is also achieved by means of a vehicle, in particular a firefighting and aerial rescue vehicle, having a ladder set, the ladder set being based on one of the preceding claims.

To provide a clearer understanding, the invention will be described in more detail below with reference to the appended drawings.

Figure 2:
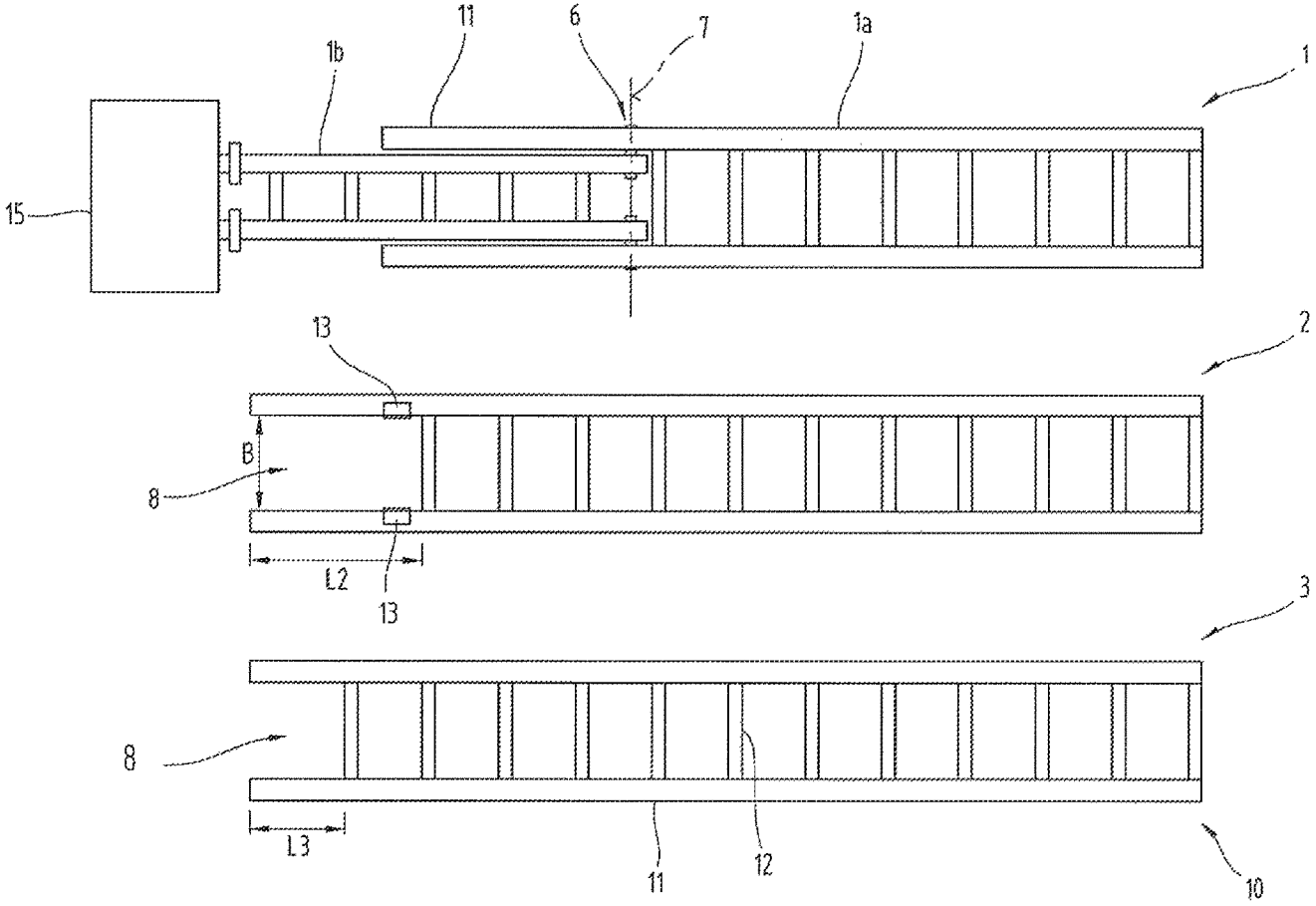
Figure 2A:
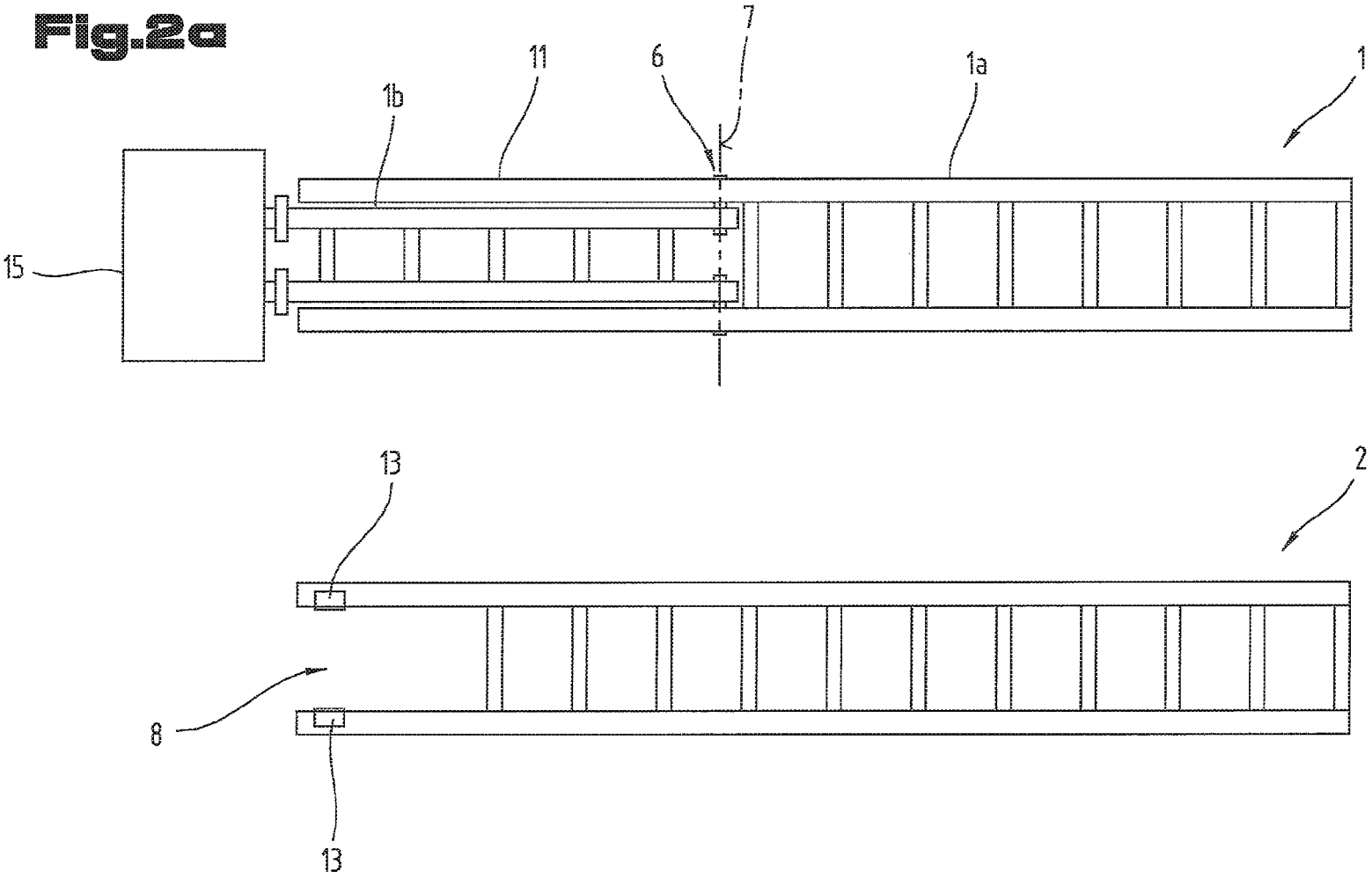
Figure 3:
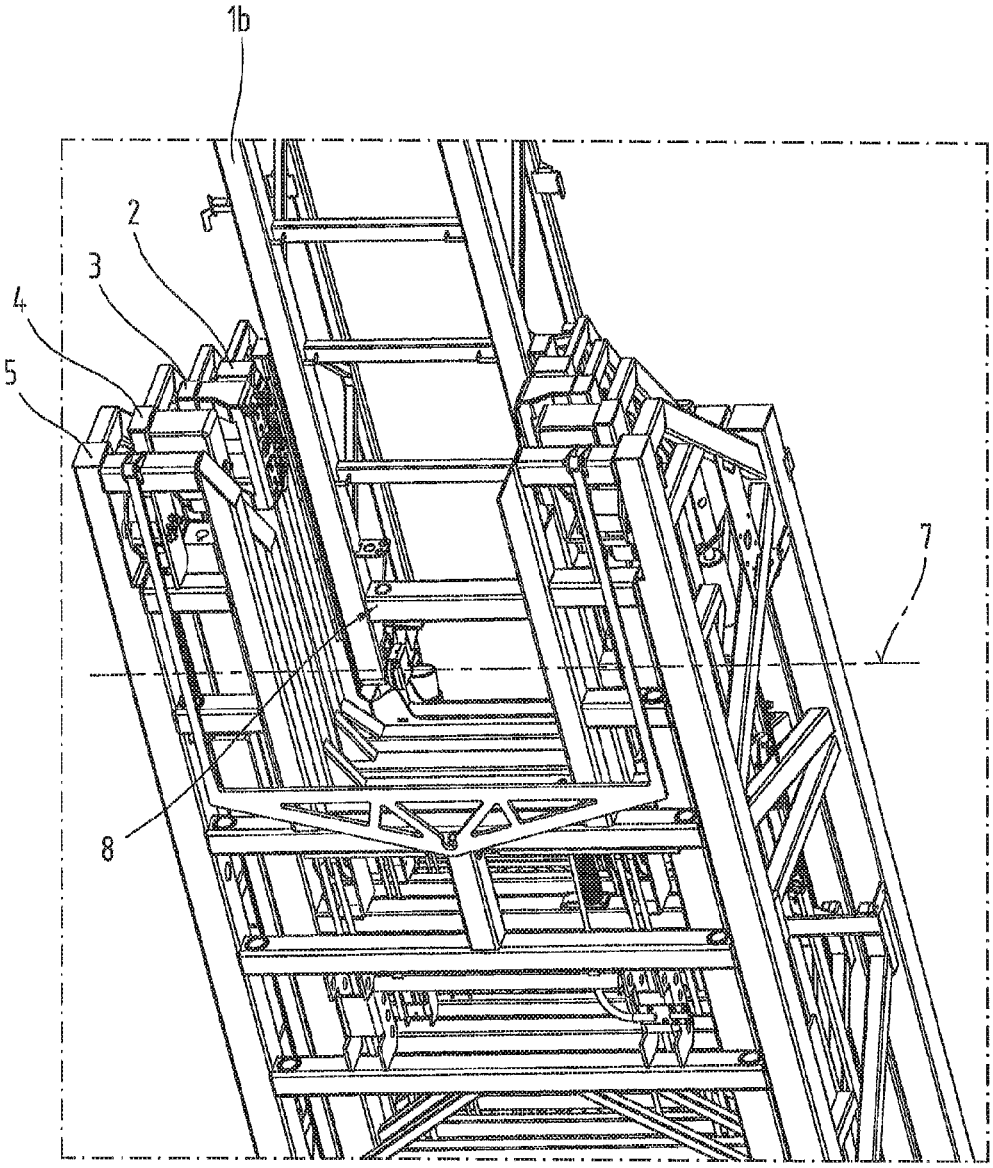
Figure 4:
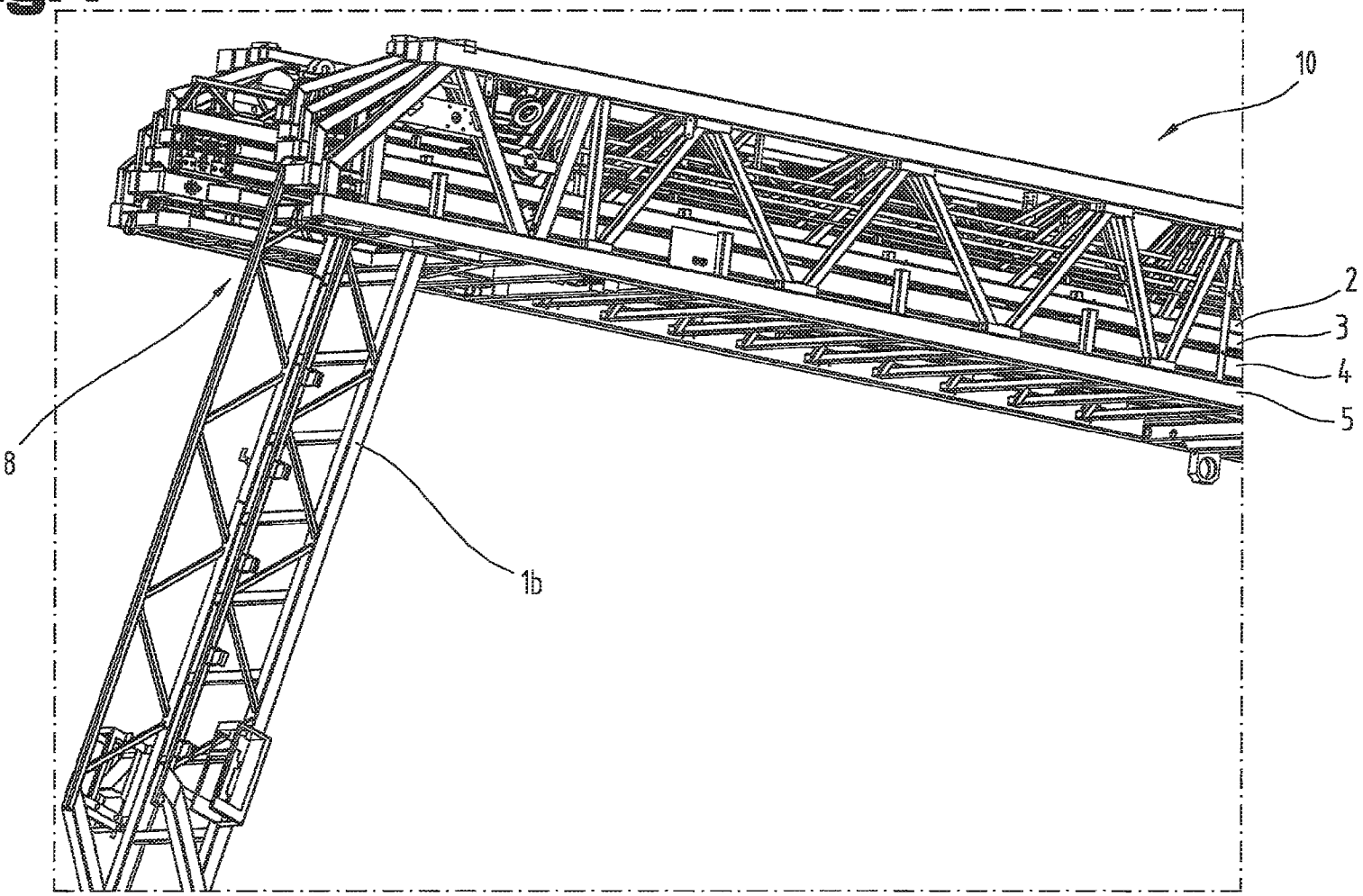
Figure 5:
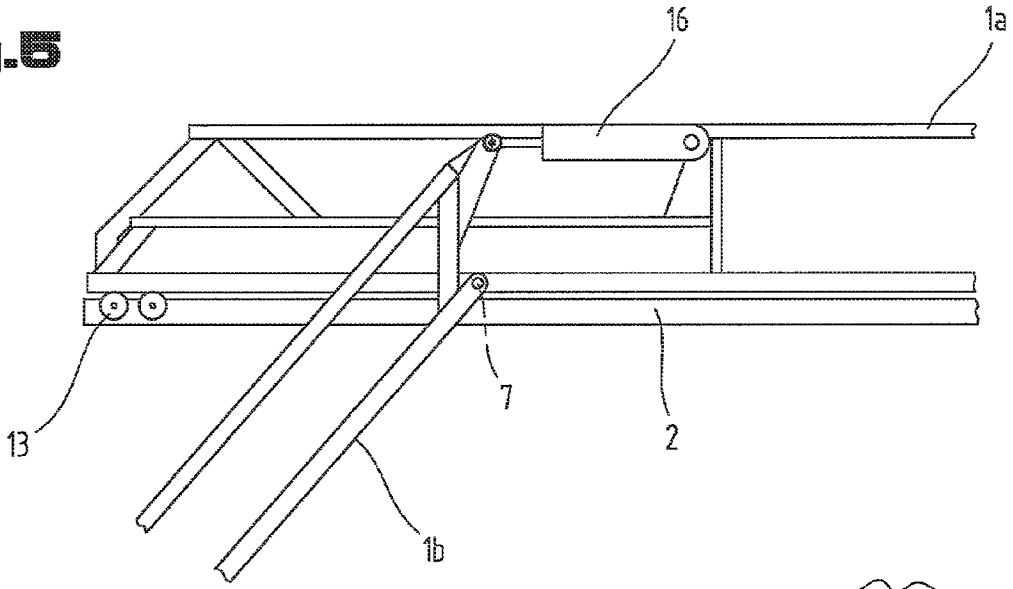
Figure 6:
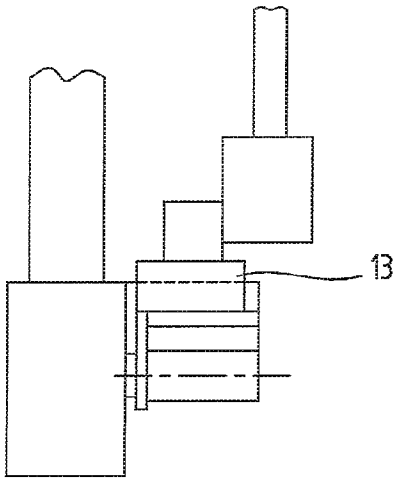
Figure 7:
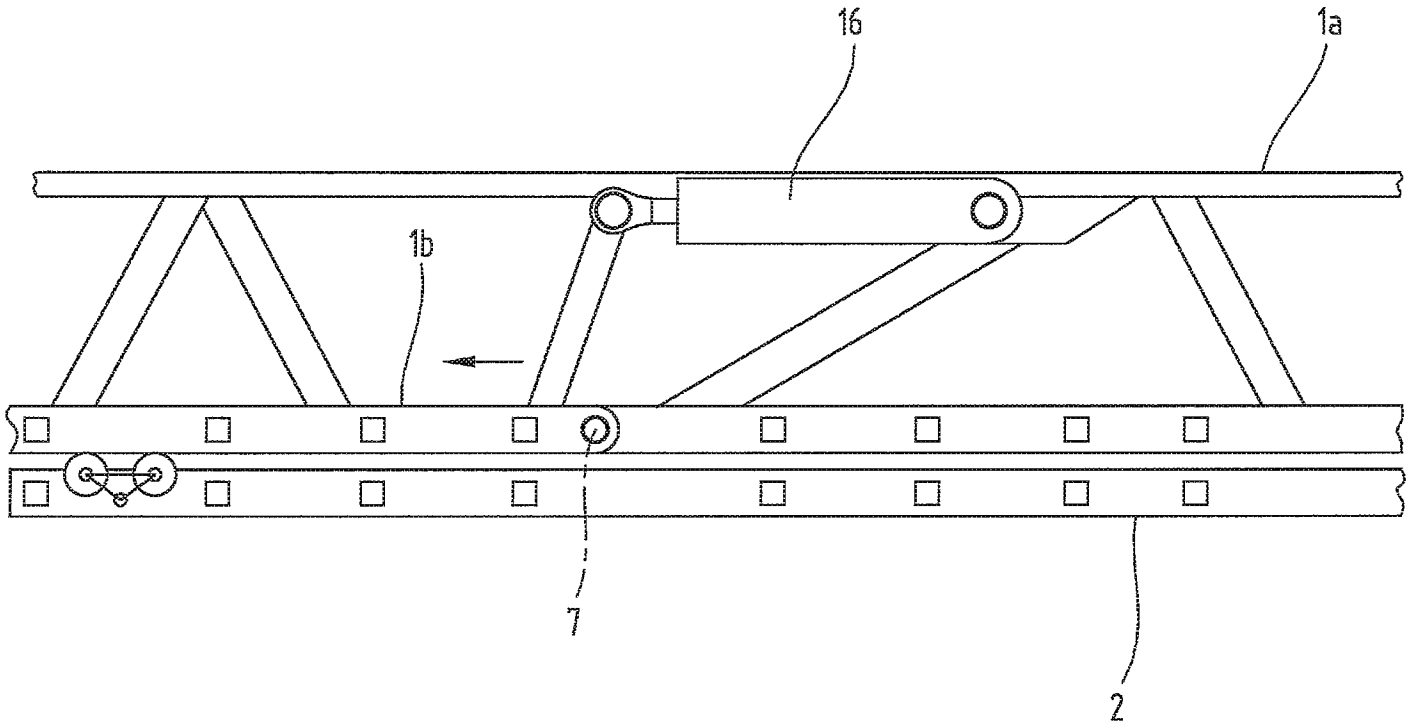
Figure 8:
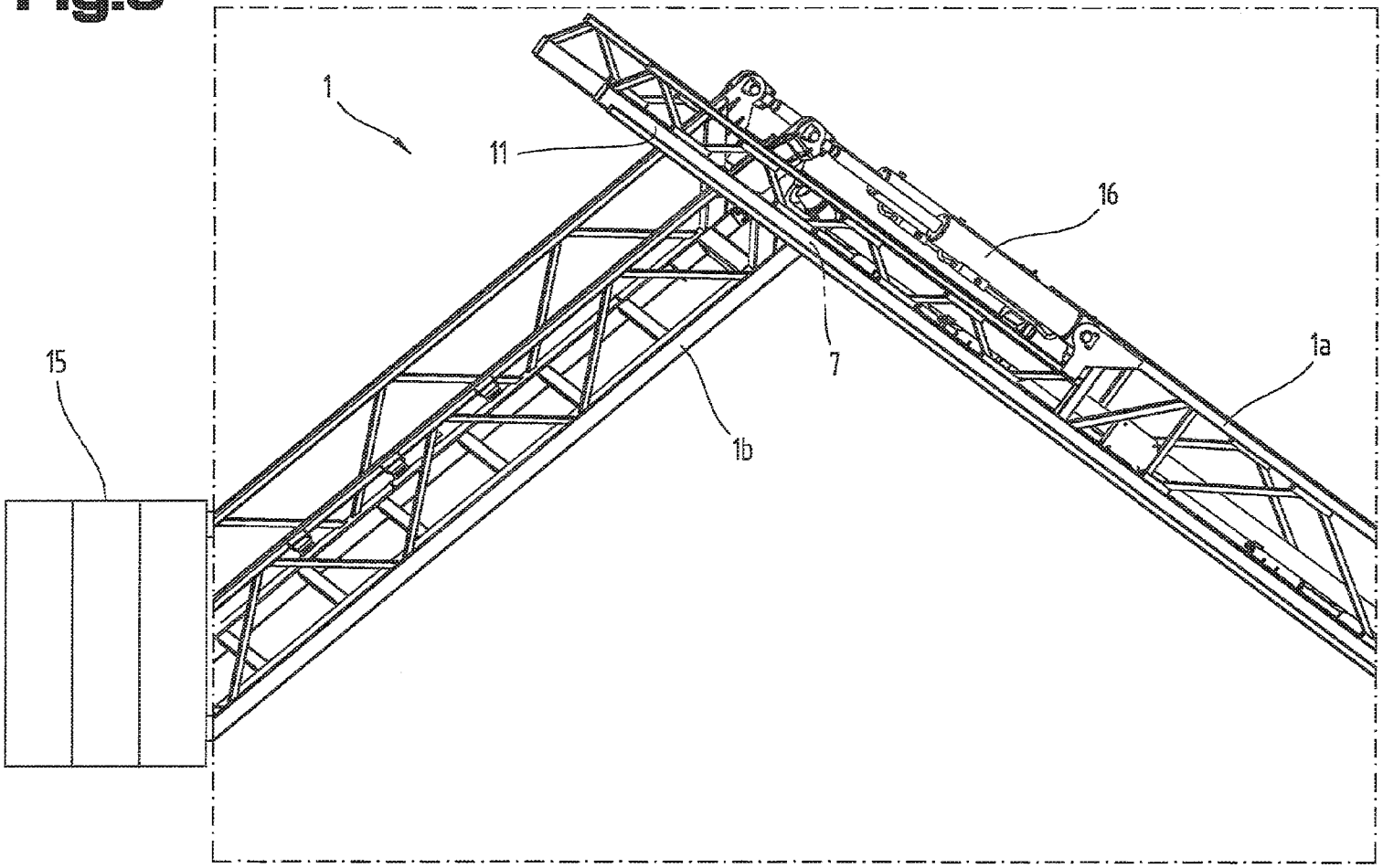
Figure 9:
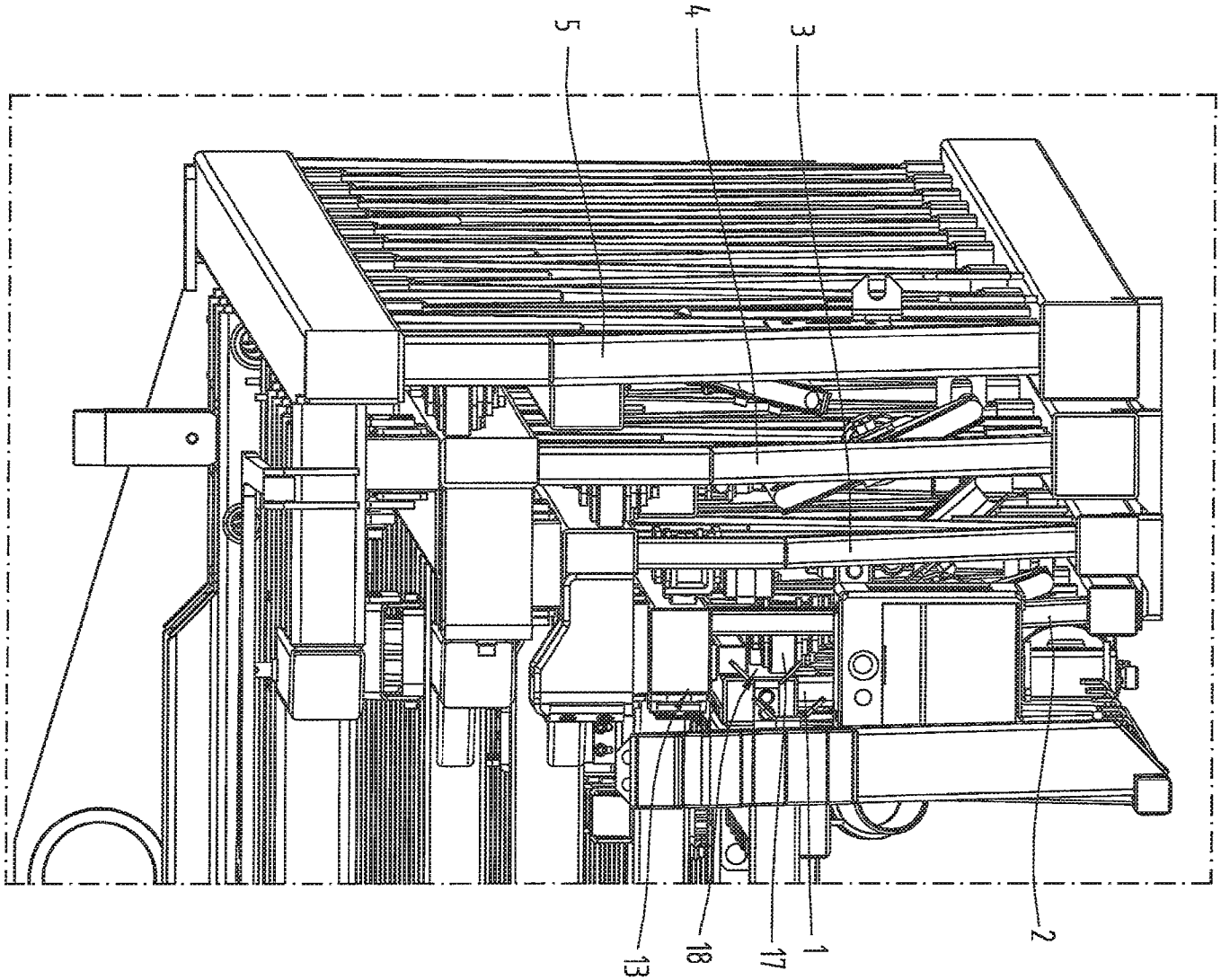
Figure 10:
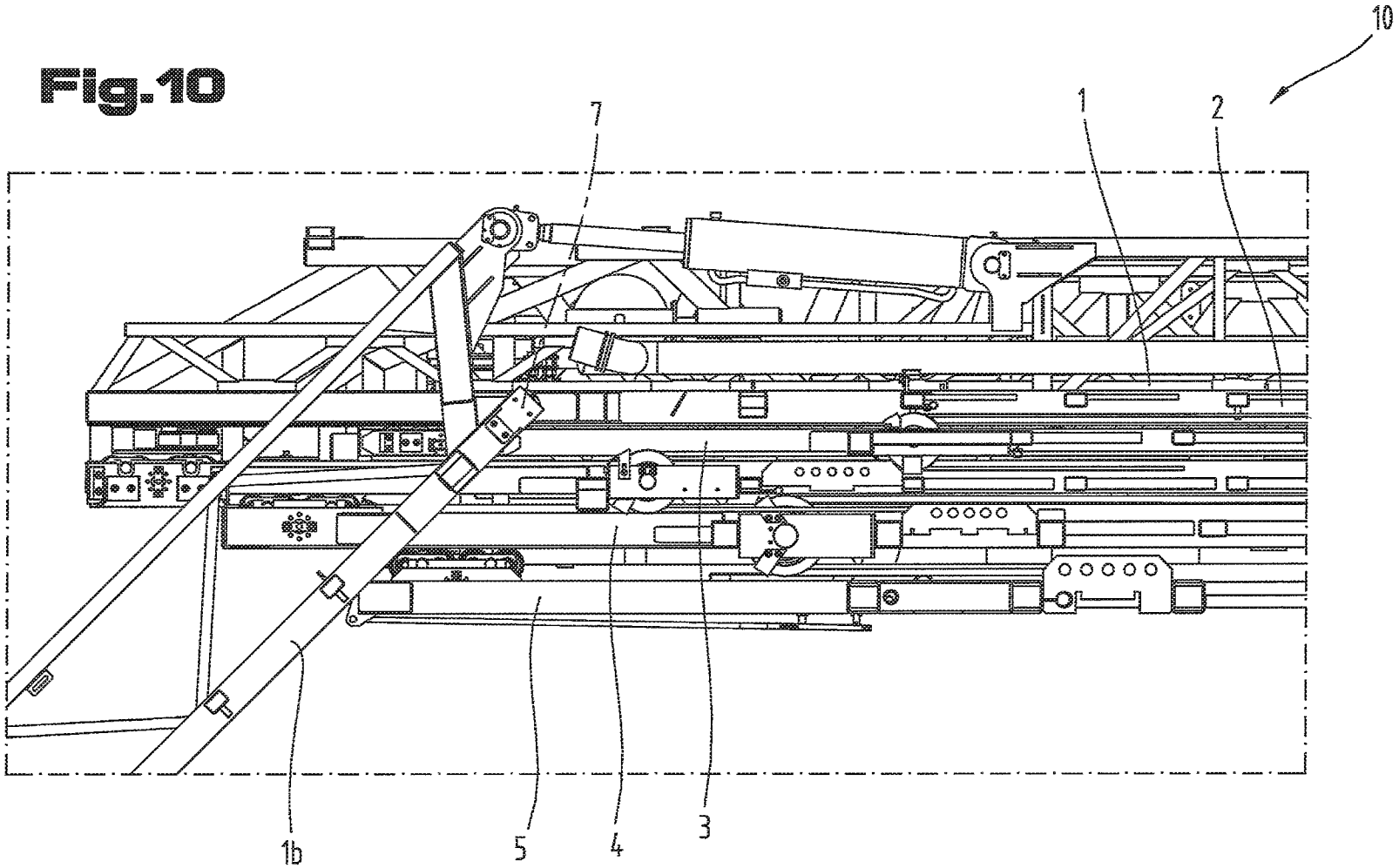
Figure 11:
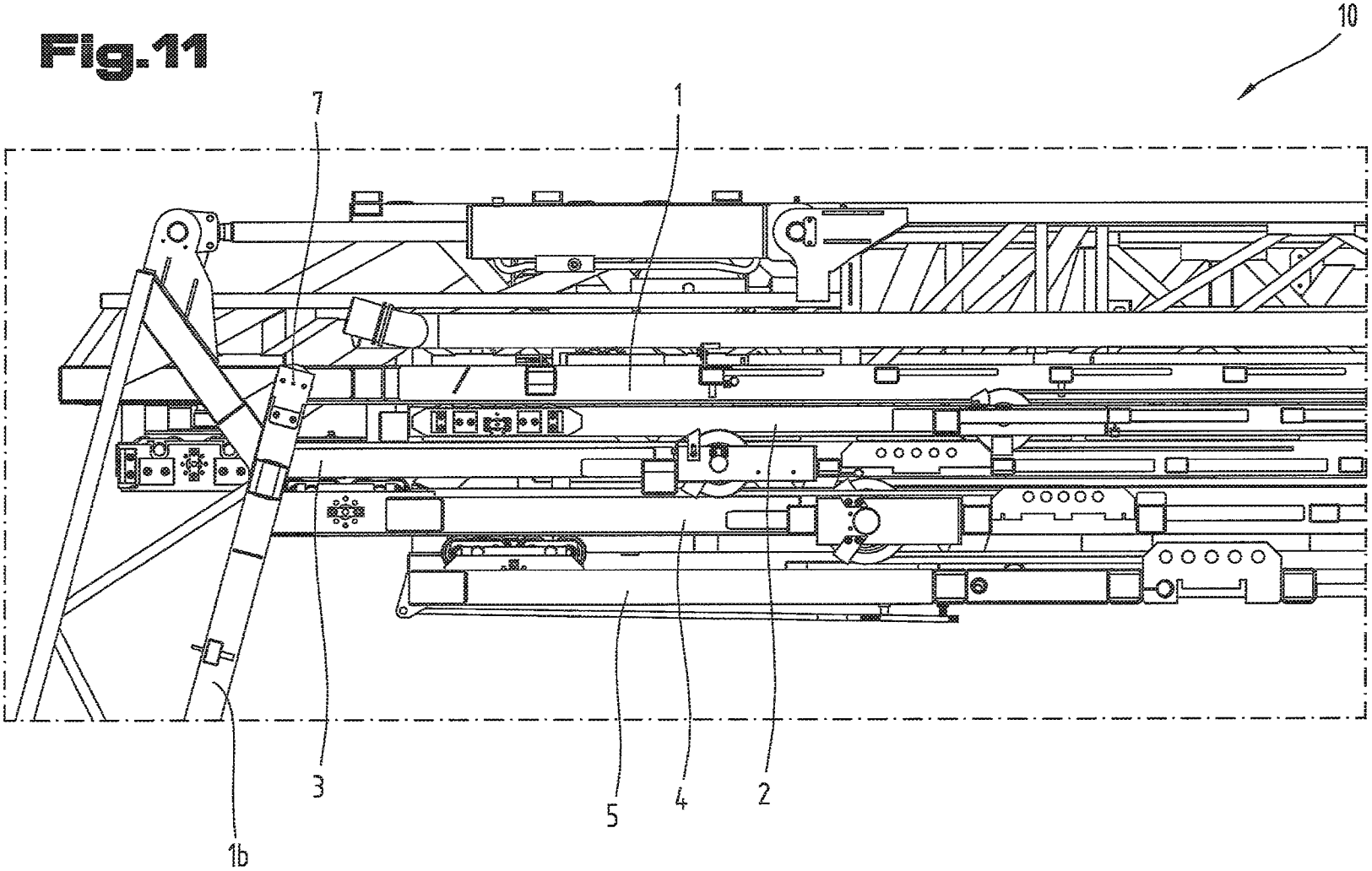

These are highly schematic, simplified diagrams illustrating the following:

FIG. 1 a vehicle as proposed by the invention;

FIG. 2 a ladder set as proposed by the invention;

FIG. 2*a* a variant of the ladder set illustrated in FIG. 2;

FIG. 3 a detail of a ladder set from underneath;

FIG. 4 the ladder set illustrated in FIG. 3 with the second ladder section in a tilted position;

FIG. 5 two ladder parts of a ladder set with the second ladder section in a tilted position;

FIG. 6 the mounting of the uppermost ladder part on the ladder part lying below;

FIG. 7 two ladder parts of a ladder set with the second ladder section in the extended position;

FIG. 8 an uppermost ladder part with the second ladder section tilted;

FIG. 9 the mounting of the uppermost ladder part on the ladder part lying below in greater detail;

FIG. 10 an embodiment of a ladder set with the second ladder section tilted and FIG. 11 another embodiment of a ladder set with the second ladder section tilted.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

The embodiments illustrated as examples represent possible variants of the ladder set, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the ladder set, it and its constituent parts are illustrated to a certain extent out of scale and/or on an enlarged scale and/or on a reduced scale The objective underlying the independent inventive solutions may be found in the description.

Above all, the individual embodiments of the subject matter illustrated in the drawings constitute independent solutions proposed by the invention in their own right. The objectives and associated solutions proposed by the invention may be found in the detailed descriptions of these drawings.

FIG. 1 illustrates a vehicle 14, e.g. a firefighting vehicle, rescue vehicle or service vehicle, having a ladder set 10 in the form of a turntable ladder. The ladder set 10 comprises several telescopically extendable ladder parts 1, 2, 3, 4 disposed one above the other. The lowermost ladder part 5 is mounted on the rotating device of the vehicle 14 and supports the other respective ladder parts. The side rails 11 of the ladder parts respectively have a bottom spar to which the rungs are secured and a top spar which reinforces the construction and may be used as a gripping aid. The operating mechanism by means of which the ladder parts can be extended and retracted may comprise, for example, an individual telescopic system, i.e. at least the uppermost ladder part 1 can be extended independently of the other ladder parts. The other ladder parts may likewise be driven by an individual telescopic system respectively or may be grouped with a common synchronously telescoping system. Alternatively, all the ladder parts may be operable by means of a common synchronously telescoping system.

As may be seen from FIG. 1, the uppermost ladder part 1 comprises two ladder sections 1*a*, 1*b*. They are connected to one another by means of an articulated link 6 having an articulation axis 7 parallel with the rungs 12. As a result, the second ladder section 1*b*, which will also be referred to as the articulating part, can be tilted relative to the first ladder section 1*a*. Mounted at the head end of the articulating part 1*b* is a platform 15 in the form of a working cage.

Like the first ladder section 1*a*, the second ladder section 1*b* has rungs 12 extending between the side rails 11 and constitutes an extension of the first ladder section 1*a*. Due to the pivotable second ladder section 1*b*, the deployment range of a ladder set 10 is increased and in particular, locations that would otherwise be difficult to access can be reached. Furthermore, the platform 15 can be set down on the ground to accommodate people or allow them to climb out.

As indicated in FIG. 1, a gap 8 is provided in the head regions of the ladder parts 2, 3, 4, 5 lying below the uppermost ladder part 1 respectively. The gaps disposed between the side rails 11 of the respective ladder part are open towards the tip of the ladder and are continuous between the front face and rear face of the ladder part, i.e. the gap 8 is free of continuous rungs and extends from the uppermost continuous rung as far as the ladder part tip. As a result, the second ladder section 1*b* can be tilted through the gap 8, even in a position in which the articulation axis 7 overlaps the ladder part lying below. This being the case, it is no longer necessary to move the articulation axis 7 out beyond the ladder part lying below.

To provide a clearer understanding, FIG. 2 illustrates individual ladder parts 1, 2, 3 next to one another. In the operating position for which it is designed, the uppermost ladder part 1 lies with its two ladder sections 1*a*, 1*b* on the ladder part 2 lying below and is guided by it. When the uppermost ladder part 1 is in the position fully retracted into the ladder part 2 lying below, both the first ladder section 1*a* and the second ladder section 1*b* overlap ladder part 2. In its head region, the ladder part 2 has a gap 8 extending along the side rails 11 across the length L2 and a width B. The width B is selected so as to be at least large enough to enable the second ladder section 1*b* to be tilted between the side rails 11 of the ladder part 2 lying below.

The length L2 of the gap 8 (in other words the extension of the gap 8 in the direction along the side rails 11), however, is longer than the distance between two adjacent rungs 12 of a ladder part 2.

The length L2 of the gap 8 is preferably at least twice as big, particularly preferably at least three times as big, as the regular distance between two adjacent rungs 12 of a ladder part 2.

Based on other preferred variants, the length L2 of the gap 8 is at least a quarter, preferably at least half, of the length of the second ladder section 1*b*. To enable tilting even in the fully retracted position, the length L2 of the gap 8 is substantially as long as the second ladder section 1*b*.

As may be seen from FIG. 2, the ladder part 3 lying underneath the second ladder part 2 also has a gap 8 in its head region, the length L3 of which is slightly shorter than that of the second ladder part 2.

To enable the second ladder section 1*b* (articulating part) to be lowered down through the gaps 8, the uppermost ladder part 1 must be extended by a specific distance until the articulation axis 7 lies in the region of the gap 8 of the ladder part 2 lying below. As already mentioned, the length L2, L3, etc. of the gap 8 may also be selected so as to be big enough to enable the second ladder section 1*b* to be tilted, even in the fully retracted position, in an alternative embodiment.

It is also not absolutely necessary for the ladder parts 3, 4, 5 respectively lying underneath the second ladder part 2 to have a shorter gap 8 than the second ladder part 2 as illustrated in FIG. 2.

FIG. 2 also illustrates the feature whereby the side rails 11 of the first ladder section 1*a* extend out beyond the articulation axis 7 and at least partially overlap the second ladder section 1*b*. In the ladder part 2 lying below, disposed in its head region, are guide elements 13 in the form of rollers, also referred to as head rollers. The uppermost ladder part 1 is guided on the guide elements 13 and in the position in which the uppermost ladder part 1 is fully retracted into the ladder part 2 lying below, the sections of the side rails 11 of the first ladder section 1*a* extended out beyond the articulation axis 7 lie on the guide elements 13. The advantage of this embodiment resides in the fact that the first ladder section 1*a* is continuously guided and supported by the rollers provided as guide elements 13. This prevents any height offset or discontinuity during the extending and retracting operation at a transition from the second to the first ladder section and vice versa.

The sections of the side rails 11 extending out beyond the articulation axis 7 are at least twice as long as the distance between two adjacent rungs 12 of a ladder part 1. By preference, the length of the sections of the side rails 11 extending out beyond the articulation axis 7 are at least a quarter, preferably at least half, of the length of the second ladder section 1*b*. In addition to rotatably mounted rollers, it would also be possible to use sliding blocks as guide elements 13, for example.

FIG. 2*a* illustrates a variant in which the guide elements 13, e.g. rollers, are disposed directly at the end of the second ladder section 2. Lateral guides could also be provided in the same region. In the uppermost ladder part 1, the side rails 11 of the first ladder section 1*a* are pulled forwards towards the ladder tip and therefore lie against or on the guide elements 13, even when the ladder set 10 is in the retracted state. In the embodiment illustrated in FIG. 2, only two ladder parts 1, 2 are provided. Naturally, each of the embodiments described in this application could also be designed with more than two ladder parts.

FIG. 3 illustrates a ladder set 10 viewed from underneath with the uppermost ladder part 1 partially extended. In this embodiment, the length L2, L3, etc. of the gaps 8 of all of the ladder parts 2, 3, 4, 5 lying below is substantially the same size. The articulation axis 7 is already disposed on a level with the gaps 8. In this position, the second ladder section 1*b* can be tilted through the gaps 8. The second ladder section 1*b* is illustrated in this inclined position in FIG. 4.

FIG. 5 illustrates the same position as FIG. 4 but from a side view, only the uppermost ladder part 1 and the ladder part 2 lying directly underneath being shown. Also illustrated are the extended side rails 11 of the first ladder section 1*a* supported by the rollers 13. A drive 16 in the form of a cylinder-piston unit drives the downward and upward pivoting movement of the articulating part 1*b*. In the embodiment illustrated here, the articulation axis 7 is disposed in the region of the bottom spar and the drive 16 is disposed in the region of the top spar of the side rails 11. It would naturally also be conceivable to opt for the reverse arrangement.

FIG. 6 shows a detailed view illustrating how the first ladder part 1 is retained on the ladder part 2 lying below. The bottom spar of the uppermost ladder part 1 lies with a running surface on the rollers 13 of the ladder part 2 lying below.

FIG. 7 illustrates a variant in which the side rails 11 of the first ladder section 1*a* extend only as far as the articulation axis 7. However, this causes a problem insofar as the articulation point incorporating the articulation axis 7 must run across the guide elements 13 provided in the form of head rollers, which on the one hand results in a discontinuity (height offset) during the extension and retraction operation and on the other hand results in a situation in which greater wear can be anticipated.

As explained above, this problem can be addressed by using an uppermost ladder part 1 of the type illustrated in FIG. 8, for example. Based on this preferred embodiment, the side rails 11 of the first ladder section 1*a* extend out beyond the articulation axis 7. As may be seen from FIG. 8, the sections of the side rails 11 extending out beyond the articulation axis 7 serve as a gripping aid and make the transition between the two ladder sections 1*a*, 1*b* easier. Furthermore, the uppermost ladder part 1 may be supported via the side rails, in particular by their bottom spars, on guide elements 13, in particular the head rollers of the ladder part 2 lying below.

FIG. 9 again provides a detailed illustration of how the uppermost ladder part 1 is supported on the ladder part 2 lying below. In this embodiment, bottom rollers 13 are provided as guide elements on which the uppermost ladder part 1 lies by means of its running surface and lateral guide rollers 17 which guide the uppermost ladder part 1 from the side. In order to increase safety in terms of preventing the uppermost ladder part 1 from becoming derailed, an anti-derail lock 18 is provided, which forms an intermediate space in conjunction with a roller 13 into which extends the part of the bottom spar of the uppermost ladder part 1 that also constitutes the running surface communicating with the roller 13.

FIGS. 10 and 11 illustrate two examples of a ladder set 10. In this instance, the gaps 8 in the respective ladder parts 2, 3, 4, 5 lying below are of differing lengths. For example, in the case of the ladder set illustrated in FIG. 10, a tilting action is possible about the illustrated maximum angle. In the case of FIG. 11, the maximum tilting angle for the same constellation is greater than that of FIG. 10 because the gap of the ladder part lying underneath is also bigger.

The principle underlying the invention is not restricted to the embodiments described and illustrated. In particular, the length L2, L3, etc. of the gap 8 may vary in one or all of the ladder parts lying below. However, the gap 8 is preferably dimensioned so that when the entire ladder set 10 is in the fully extended position, there are no points without rungs 12 along the extended ladder. The gaps 8 in the individual ladder parts are preferably selected to be exactly of such a size that when the ladder set 10 is in the fully extended position, there are no overlapping rungs of two adjacent ladder parts. At the minimum overlap of the ladder parts in the fully extended position, only the respective ladder part lying at the top has rungs to enable climbing on and off.

LIST OF REFERENCE NUMBERS

1 Uppermost ladder part
1*a* First ladder section of the uppermost ladder part 1
1*b* Second ladder section of the uppermost ladder part 1
2 Second ladder part
3 Third ladder part
4 Fourth ladder part
5 Fifth ladder part
6 Articulated link
7 Articulation axis
8 Gap
10 Ladder set
11 Side rail
12 Rungs
13 Guide elements
14 Vehicle
15 Platform
16 Drive
17 Lateral guide rollers
18 Anti-derail lock
L Length of the gap 8
B Width of the gap 8

The invention claimed is:

1. A set of extendable ladders comprising:

(a) an uppermost first ladder part comprising a plurality of first side rails and a plurality of first rungs running between the first side rails, wherein the first ladder part comprises first and second ladder sections and an articulated link interconnecting the first and second ladder sections, wherein the articulation link has an articulation axis running substantially parallel with the first rungs; and (b) a second ladder part below the first ladder part comprising a plurality of second side rails and a plurality of second rungs running between the second side rails;

wherein the first ladder part is telescopically extendable and retractable with respect to the second ladder part;

wherein the first ladder section and the second ladder section of the first ladder part overlap the second ladder part when the first ladder part has been fully retracted into the second ladder part; and wherein the second ladder part has a front face, a rear face, a head region between the second side rails, a tip, and a second ladder part gap open towards the tip in the head region and continuous between the front face and the rear face such that when the articulation axis of the articulation link interconnecting the first and second ladder sections of the first ladder part overlaps the second ladder part, the second ladder section of the first ladder part can be tilted through the second ladder part gap of the second ladder part about said articulation axis.

2. The ladder set according to claim 1, wherein the second ladder part gap extends more in the direction along the second side rails than between two adjacent second rungs.

3. The ladder set according to claim 1, wherein the second ladder part gap extends a first extension distance in the direction along the second side rails and a second extension distance between two adjacent second rungs and the first extension distance is at least twice as big as the second extension distance.

4. The ladder set according to claim 3, wherein the second ladder section has a second ladder section length and the first extension distance is at least a quarter of the second ladder section length.

5. The ladder set according to claim 4, wherein the first extension distance substantially corresponds to the second ladder section length.

6. The ladder set according to claim 4, wherein the first side rails have first side rail sections extending beyond the articulation axis and at least partially overlapping the second ladder section.

7. The ladder set according to claim 6, wherein the first side rail sections are at least twice as long as a distance between two adjacent first rungs.

8. The ladder set according to claim 6, wherein the first side rail sections have a first side rail sections length at least a quarter of the second ladder section length.

9. The ladder set according to claim 6, wherein the first ladder part is guided against or on guide elements mounted in the second ladder part, and when the first ladder part is fully retracted into the second ladder part, the first side rail sections lie against or on the guide elements and the guide elements lie against the first side rail sections.

10. The ladder set according to claim 9, wherein the guide elements are disposed in the head region of the second ladder part.

11. The ladder set according to claim 9, wherein the guide elements are rotatably mounted rollers.

12. The ladder set according to claim 3, further comprising a third ladder part below the second ladder part comprising a plurality of third side rails, a plurality of third rungs running between the third side rails, and a third ladder part gap, wherein the second ladder part is retractable into the third ladder part, and wherein the second ladder section can be tilted through the second and third ladder part gaps about the articulation axis when the first ladder part is retracted into the second ladder part and the second ladder part is retracted into the third ladder part so that the articulation axis overlaps the second and third ladder parts.

13. The ladder set according to claim 12, wherein the third ladder part gap extends a third extension distance in the direction along the third side rails and wherein (a) the second extension distance is bigger than the third extension distance or (b) the third extension distance is bigger than the second extension distance.

14. The ladder set according to claim 12, further comprising a fourth ladder part below the third ladder part comprising a plurality of fourth side rails, a plurality of fourth rungs running between the fourth side rails, and a fourth ladder part gap, wherein the third ladder part is retractable into the fourth ladder part, and wherein the second ladder section can be tilted through the second, third, and fourth ladder part gaps about the articulation axis when the first ladder part is retracted into the second ladder part, the second ladder part is retracted into the third ladder part, and the third ladder part is retracted into the fourth ladder part so that the articulation axis overlaps the second, third, and fourth ladder parts.

15. The ladder set according to claim 1, wherein the first side rails comprise a bottom spar and a top spar and the articulation axis of the articulated link is disposed in the bottom spar or in the top spar.

16. The ladder set according to claim 1, wherein the ladder part has substantially the same length as the second ladder part.

17. The ladder set according to claim 1, wherein the second ladder section has an end remote from the articulation axis supporting a platform.

18. The ladder set according to claim 1, wherein the ladder set is a constituent part of a turntable ladder.

19. The ladder set according to claim 1, wherein the ladder set is disposed on an emergency vehicle.

20. A vehicle, having a ladderset, wherein the ladder set is designed according to claim 1.

* * * * *